United States Patent [19]

Obst et al.

[11] Patent Number: 4,901,939

[45] Date of Patent: Feb. 20, 1990

[54] REEL

[75] Inventors: Donald L. Obst, Hickory; R. E. Shrum, Newton, both of N.C.

[73] Assignee: Siecor Corporation, Hickory, N.C.

[21] Appl. No.: 893,917

[22] Filed: Aug. 7, 1986

[51] Int. Cl.[4] ..... B65H 75/14

[52] U.S. Cl. ..... 242/118.4; 242/117

[58] Field of Search ..... 242/118.4, 117

[56] References Cited

U.S. PATENT DOCUMENTS

| | | | |
|---|---|---|---|
| 1,842,143 | 1/1932 | Bowen | 242/118.4 |
| 2,262,101 | 11/1941 | Harris | 242/118.4 |
| 2,376,152 | 5/1945 | Karle | 242/118.4 |
| 2,816,310 | 12/1957 | Nale | 242/117 |
| 3,534,920 | 5/1968 | McGrath et al. | 242/117 |
| 3,784,166 | 1/1974 | Renfroe | 242/117 |
| 3,870,245 | 3/1975 | Witteborg | 242/118.4 |
| 3,940,086 | 2/1976 | Stoquelet | 242/118.6 |
| 4,050,648 | 9/1977 | Tisma | 242/118.4 |

FOREIGN PATENT DOCUMENTS

| | | | |
|---|---|---|---|
| 252994 | 6/1926 | United Kingdom | 242/118 |
| 510293 | 7/1939 | United Kingdom | 242/117 |
| 954245 | 4/1964 | United Kingdom | 242/118.4 |

*Primary Examiner*—Katherine A. Matecki

*Attorney, Agent, or Firm*—Roy B. Moffitt

[57] ABSTRACT

A reel containing first and second spaced-apart flanges, a first tubular member disposed between and attached to the first and second flanges at a point spaced apart from the free edges of the flanges so that the first tubular member and a portion of the flanges partially delimit a first space; a second tubular member coaxially disposed inside of, spaced apart from the first tubular member and affixed to the flanges, the first and second tubular members and the spaced apart flanges delimiting a second space; and, an aperture in at least one of the flanges, communicating with the first and second spaces.

5 Claims, 1 Drawing Sheet

REEL

BACKGROUND OF THE INVENTION

Most wire or cable wound on a spool or a reel presents a problem. This problem relates to protecting some 30 meters of excess length of cable normally passed through a hole in one of the flanges and left outside of the space where the balance of the cable is wound. This excess length forms a test length required by quality control at the manufacturer and by customers of the manufacturer. The prior art teaches one to store this excess length by coiling it and affixing the coil to the side of the reel with a tape. This renders the coil excess length unprotected and it often gets damaged in use or in transit to the customer. This arrangement is also inadequate because the tape's adhesive weakens and the coil falls free from the flange. The prior art also teaches to create a groove in one of the flanges or to construct a channel on the outside surface of one of the flanges in which the coil is disposed. While this groove or channel is an improvement over using adhesive tape, it is still unsatisfactory because some means has to be used to affix the coil within the groove or channel and this usually results in a coil falling out of the groove or channel in transit or in use, thereby creating the same problem the channel or groove was thought to solve.

BRIEF SUMMARY OF THE INVENTION

The invention is a simple one comprising a reel made up of first and second spaced apart flanges. Each of the flanges have a free edge. The reel also contains a first and second tubular members, the first tubular member disposed between and attached to the first and second flanges at a point spaced apart from the free edge of each flange so that the first tubular member and a portion of the flanges partially delimit a first space. This is the space in which a bulk of the wire or cable is usually wound. A second tubular member is coaxially disposed inside of and spaced apart from the first tubular member and it too is affixed to the flanges. The spaced apart nature of the first and second tubular members in combination with the two flanges delimit the second space and it is this second space in which the excess length of cable is conveniently stored. There is an aperture in at least one of the flanges, the aperture communicating with the first and second spaces and there may be another aperture in the first tubular member. It also communicates with the first and second spaces.

In use, cable is wound on the outermost surface of the first tubular member, a terminal portion of which forms an excess test length. The excess test length is then threaded through the aperture in the first tubular member or the aperture in one of the flanges that communicates with the first and second spaces and is then conveniently stored in the second space delimited by the first and second flanges and first and second spaced apart tubular members.

The terms "reel" and "spool" are used in this disclosure interchangeably. Furthermore, the terms "wire", "cable", "optical fiber", and "fiber optic cable" are also used interchangeably in this disclosure.

DETAILED DESCRIPTION OF THE INVENTION

Figure 1:
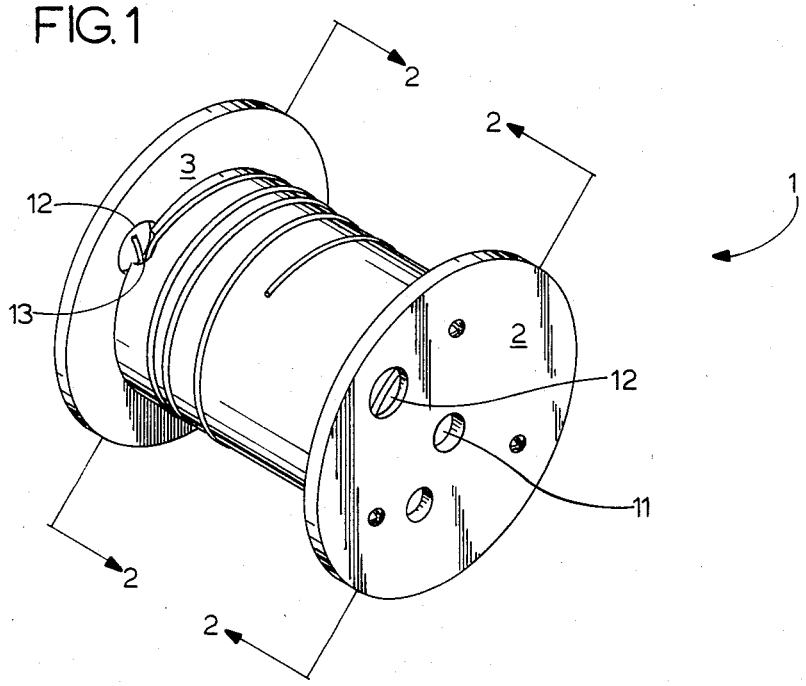
FIG. 1 is a prospective view of the reel of the present invention.
Figure 2:
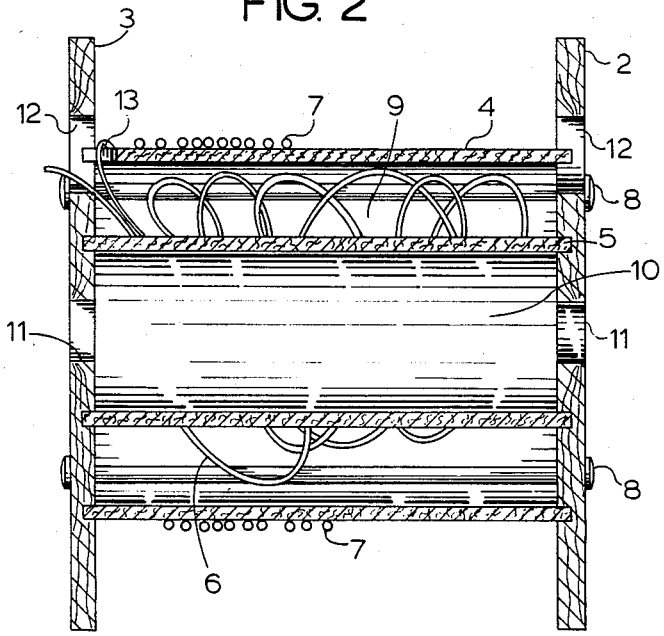
FIG. 2 is a cross section of the reel of the invention, along lines 2—2 of FIG. 1.

Shown by element 1 in FIGS. 1 and 2, is the reel of the present invention. Elements 2 and 3 are flanges spaced apart from one another. Interposed between flanges 2 and 3 is a first tubular member 4 and second tubular member 5. First tubular member 4 is spaced apart from second tubular member 5. Tubular members 4 and 5 in combination with flanges 2 and 3 delimits space 9 in which excess cable length 6 can be conveniently stored as more fully described hereafter. In flange 2 is aperture 12. A like aperture 12 can be in flange 3. It will be noted that aperture 12 communicates not only with space 9, but also with that space partially delimited by flanges 2 and 3 and the outermost surface of first tubular member 4. Cable, optical fiber or fiber optic cable 7 is wound on tubular member 4 in the conventional manner, only one course of wire or cable being shown in FIG. 2 as an example only. Excess length 6, not wound on tubular member 4, is threaded through the aperture 12 and stored in space 9 or threaded through aperture 13 and stored in space 9.

Element 8 is bolt or other fastener means used to compress flanges 2 and 3 onto the terminal portions of tubular members 4 and 5 to hold the reel or spool together. Arbor hole 11 in flanges 2 and 3 provide a space for an axle or an arbor be placed therein so that the spool may be rotated in a conventional manner. An arbor (not shown) obviously may occupy a portion of space 10 delimited by the innermost surface of tubular member 5 and further delimited by flanges 2 and 3. If cable were stored inside of tube 4 without tube 5, damage will occur during the unreeling process due to the fact that cable 6 has a tendency to wrap and bind the arbor. Tubular member 5 prevents cable 6 from coming on contact with an arbor disposed in tube 5 and prevents binding of cable 6 with the arbor.

Because cable 6 is stored inside of space 9, it is not exposed to the prior art unwanted forces it would otherwise be exposed to if it were coiled in a coil and disposed in the outer surface of flanges 2 and 3.

The materials of construction of the reel may be any convenient material such as steel, wood, paper, particle board, or plastic, all of which have been found to be satisfactory. Aperture 13 is optional; however, it adds a degree of convenience its absence does not otherwise provide. It is essential, however, that aperture 12 be in the position that it is shown and that such aperture communicates with space 9 and that space partially delimited by the outermost surface of tube 4 and flanges of 2 and 3.

We claim:

1. A reel comprising:

(a) first and second spaced apart flanges, each having a free edge;

(b) a first tubular member disposed between and attached to the first and second flanges at a point spaced apart from the free edge of each flange so that the first tubular member and a portion of the flanges partially delimit a first space;

(c) a second tubular member coaxially disposed inside of and spaced apart from the first tubular member and affixed to the flanges, the first and second tubular members delimiting a second space therebetween; and, (d) a first aperture in the first flange, said first aperture directly communicating with and juxtaposed to said first and second spaces.

2. The reel of claim 1 further including a second aperture in the second flange, said second aperture directly communicating with and juxtaposed to said first and second spaces.

3. The reel of claim 2 wherein the first flange contains a third aperture therein, which communicates with the interior of the second tubular member, and the second flange contains a fourth aperture therein, which communicates with the interior of the second tubular member.

4. The reel of claim 3 wherein the first tubular member has a fifth aperture therein, the fifth aperture being in communication with the first aperture.

5. The reel of claim 1 containing an indefinite length of wire or cable, a portion of the indefinite length of wire or cable containing a free end disposed in the second space in such a manner so that it can be removed therefrom through the first aperture and the balance of the indefinite length of wire or cable being wound on the first tubular member.

* * * * *